US011700900B2

(12) United States Patent
McCarty

(10) Patent No.: US 11,700,900 B2
(45) Date of Patent: Jul. 18, 2023

(54) EIGHT POINT MILITARY UTILITY COVER

(71) Applicant: Joshua McCarty, Escondido, CA (US)

(72) Inventor: Joshua McCarty, Escondido, CA (US)

( * ) Notice: Subject to any disclaimer, the term of this patent is extended or adjusted under 35 U.S.C. 154(b) by 0 days.

(21) Appl. No.: 17/317,051

(22) Filed: May 11, 2021

(65) Prior Publication Data

US 2021/0307440 A1 Oct. 7, 2021

Related U.S. Application Data

(63) Continuation-in-part of application No. 16/000,983, filed on Jun. 6, 2018, now abandoned.

(60) Provisional application No. 62/516,485, filed on Jun. 7, 2017.

(51) Int. Cl.
*A42B 1/02* (2006.01)
*A42B 1/205* (2021.01)

(52) U.S. Cl.
CPC ..... *A42B 1/02* (2013.01); *A42B 1/205* (2013.01)

(58) Field of Classification Search
CPC ..... A42B 1/002; A42B 1/004; A42B 1/062; A42B 1/205; A42B 3/003; A42B 1/02; F41H 3/02; F41H 3/00
See application file for complete search history.

(56) References Cited

U.S. PATENT DOCUMENTS 2,822,549 A * 2/1958 Glass ..... A42B 1/002 2/195.5
2007/0079425 A1* 4/2007 Kronenberger ..... A42B 1/24 2/209.13
2013/0263358 A1* 10/2013 Fleischmann ..... A42B 1/008 2/182.8
2014/0013486 A1* 1/2014 Leon ..... A42B 1/206 2/209.11
2018/0255858 A1* 9/2018 DaSilva ..... A42B 1/0184

FOREIGN PATENT DOCUMENTS

GB 1129863 A * 10/1968 ..... A42B 1/012

* cited by examiner

*Primary Examiner* — Katherine M Moran
*Assistant Examiner* — Erick I Lopez
(74) *Attorney, Agent, or Firm* — David B. Waller

(57) ABSTRACT

The device herein disclosed and described provides an eight point military utility cover that does not require pressing to maintain its shape. The utility cover has a cup-shaped crown portion, an outer circular rim portion, an inner circular rim portion and a semi-rigid bill portion. The crown portion is prepared from a first piece and a second piece of cloth, wherein a plurality of separate semi-rigid material sections are adhered to the first piece of cloth; one section on the front, one section on the back, three sections on the left side and three sections on the right side. The second piece of cloth is adhered to the plurality of separate semi-rigid material sections on the first piece of cloth forming a three layered sheet. This three layered sheet is folded into the cup-shaped crown and the folds are stitched to maintain the cup-shape of the crown.

15 Claims, 2 Drawing Sheets

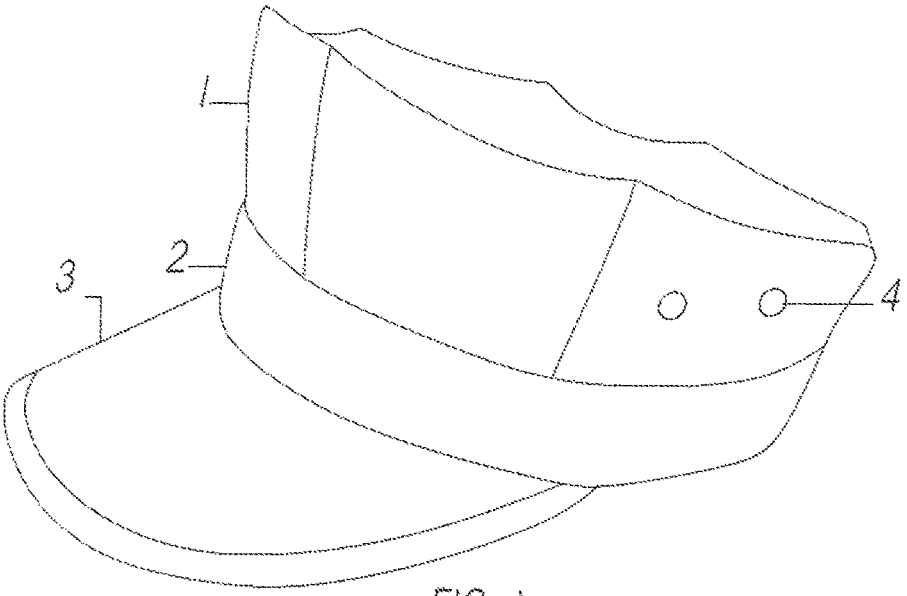
FIG. 1
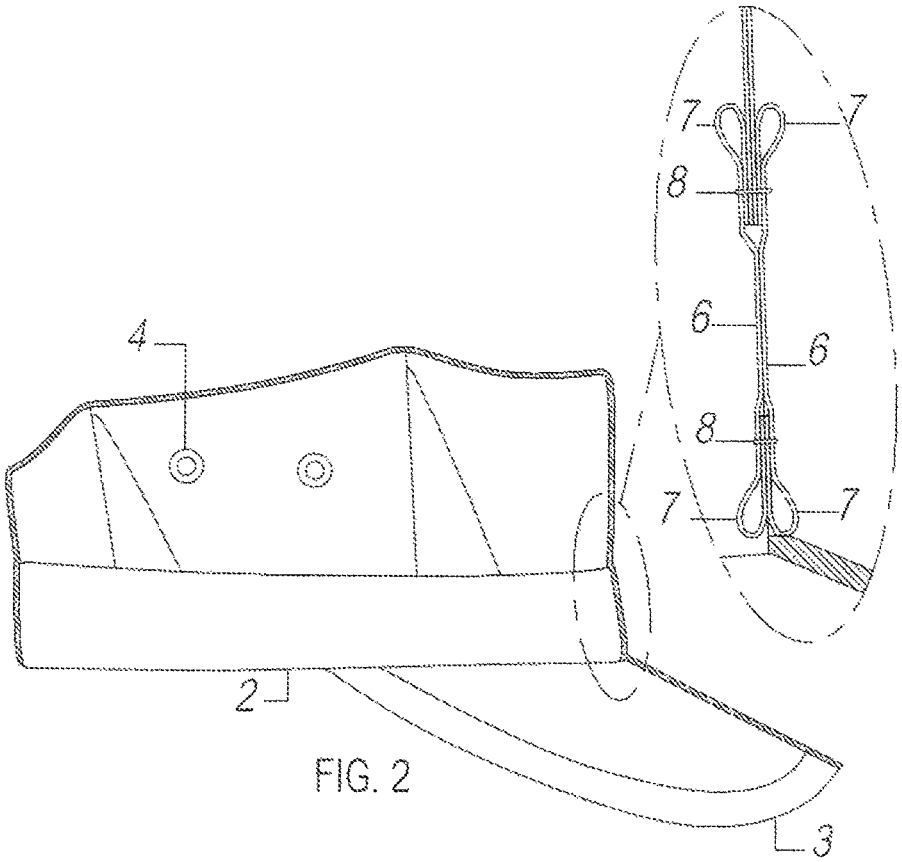
FIG. 2
FIG. 3

EIGHT POINT MILITARY UTILITY COVER

CROSS-REFERENCE TO RELATED APPLICATIONS

This application is a continuation-in-part of patent application Ser. No. 16/000,983 filed Jun. 6, 2018, which claims the benefit of provisional patent application Ser. No. 62/516,485 filed Jun. 7, 2017. These applications are incorporated herein by reference.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

TECHNICAL FIELD

The present invention relates generally to head gear. More particularly, to a hat or eight point military utility covers as they may be called by specific areas of the armed forces, that require little or no care to maintain because they are resistant to wrinkling eliminating the need for ironing while in use to meet military standards.

BACKGROUND OF THE INVENTION

The utility cover, also known as the utility cap, eight-pointed cover and eight point military utility cover is the United States Marine Corps cap, worn with their utility uniform. It is comprised of an eight-pointed crown portion, a rim portion and a bill extending outward from the rim portion. It is worn "blocked", that is, creased and peaked without wrinkles for a sharper appearance. It is also worn by the U.S. Navy and is under consideration by the United States Coast Guard's uniform board.

The utility cover was first introduced in World War II, with the Herringbone Twill utility uniform issued in 1943. It was based on a U.S. Army field cap design and a railroad engineer's cap. World War II Marines nicknamed it the "raider cap" from its use by the Marine Raiders. It was made from herringbone twill until 1959, when the material changed to cotton sateen.

It is currently issued in desert and woodland MARPAT camouflage patterns, though older versions came in M81 woodland, six-color desert, three-color desert camouflage patterns and olive drab. All versions except those worn with the Navy Working Uniform, or those worn by Navy Seabees and Beachmasters, have the Marine Corps' Eagle, Globe, and Anchor insignia on the front above the bill, the Navy versions having the wearer's rank insignia instead.

When initially purchased, the cover is provided with a stiffener that maintains the crisp appearance to meet military dress code. Unfortunately, after use this stiffener begins to break down due to environmental conditions, absorbance of sweat from the wearer as well as other impacts from general use. After continued use the cover can become wrinkled. Consequently, the wearer must iron the cover and often applying additional stiffener to reestablish the "blocked" appearance as required for military purposes. Because of the complexity of the cover, containing a top or crown portion having eight sides, a rim along the base of the crown portion and a bill extending outward from the rim, the wearer must learn the proper methods for achieving the appropriate result from ironing. Further, the amount of time required to achieve the desired appearance can be significant.

When considering the amount of time that a single individual in the military commits to maintaining their uniform, it is clear that any reduction in that time would be of benefit, allowing them to divert this energy to other potentially more important tasks.

A variety of methods known in the art have been used to instill or introduce stiffness to a fabric or material. Clothing starch is a liquid that is prepared by mixing a vegetable starch in water (earlier preparations also had to be boiled), and has been used in the laundering of clothes for centuries. Starch was widely used in Europe in the 16th and 17th centuries to stiffen the wide collars and ruffs of fine linen. During the 19th century and early 20th century, it was used to stiffen the collars and sleeve cuffs of men's shirts by applying starch as the clothes were being ironed. Aside from the smooth, crisp edges it gave to clothing, it served practical purposes as well. Dirt and sweat from a person's neck and wrists would stick to the starch rather than to the fibers of the clothing, and could be easily washed away along with the starch. After each laundering, the starch would be reapplied. Today, the product is sold in aerosol cans for home use. Inserting a thin stiff felt matrix has also been used between two pieces of fabric to instill a resistance to wrinkling during use or washing. Today, this method is used commonly in men's shirts specifically, in the collar and cuffs. This matrix has been used to toughen these areas for permanent press garments when being washed so that the collars and cuffs retain their pressed look. However, while starch can be easily removed and then reapplied this requires ironing and can be very time consuming. Stiffening felts can reduce the amount of time ironing specifically in the locations in which the felt is applied they break down over time. Since these felts cannot be easily replaced the garment must then be ironed on a regular basis. Once again introducing the amount of time necessary to maintain these clothes.

Since the material used to make the eight-point military utility cover does not maintain its shape during continued use, military personnel must make a concerted effort on a regular basis to remove creases by ironing the cover. This effort may be performed many times a week depending on the age of the cover and amount of usage and can make the cover look more worn. According to information obtained from military personnel, each effort usually takes between 10-20 minutes. This results in a significant amount of time that military personnel can utilize for other more important functions, To avoid these complicated and time consuming methods, devices have been developed to maintain the structural integrity of a variety of different hats. For example, U.S. Pat. No. 2,822,549 to Glass et al. teaches a police hat or "cap" containing a "shaping means" wherein the cap has a "substantially flat crown portion", with "depending wall portions" that are not perpendicular to the circular cap rim, and with the juncture between the two being formed as a "series of angularly related straight edges". The shaping means is made of a single non-planar "concavo-convex band of spring material" bent into an octagon shape and positioned inside the cap at the juncture of the crown and the wall portions. This band has "bends fitted between successive pairs of the angularly related straight edge portions". The band is held in place by the sharp angle created between the top and wall portions of the interior of the cap. It exerts an outward force along the juncture of the flat crown portion and depending side walls to keep the fabric of the crown taught giving a flat appearance to the top of the cap.

Another device, U.S. Pat. No. 7,937,778 to Norton, teaches a baseball cap having six panels, each in the shape of an isosceles triangle affixed together to form a dome with the tips of these panels joined at the top of the cap. These six panels are curved in shape to follow the contour of the top of the user's head. Each of the six panels is inserted into six pockets provided within the cap to protect the wearer from head injury during use. The ability to protect the wearer from injury is related to the number of protective panels provided. More specifically, a cap having more than six panels, for example eight panels, would not provide as much protection as a cap with six panels because the seams between the panels do not provide protection from impact (i.e., more seems with an eight paneled cap versus a six paneled cap) and narrower panels are more easily subject to breakage or twisting upon impact reducing impact protection.

U.S. patent application serial number 2004/0231031 to Cho teaches a baseball cap with "at least one elastic rib or wire" to maintain the cap's "predetermined shape" wherein the base of the one or more elastic ribs or wires are connected to the brim of the cap and to each other at the top of the cap forming a domed shape, preventing separation of the elastic ribs. More specifically, a space is formed within the circumferential portion of the interior side of the crown portion along the brim, and the base of the elastic dome is inserted into this space such that the elastic dome applies force to the crown portion in an outward direction. It is this physical application of outward projecting force from the ribs or wires that maintains the integrity of the baseball cap.

U.S. patent application serial number 2018/0255858 to DeSliva provides a kit containing a customizable insert made of high density polyethylene resin for inserting into the interior of the front portion of the eight-point military utility cover crown between the top and brim, behind the bill. The insert only provides support for the front three side panels of the eight point military utility cover that are positioned above the bill. The insert is provided with pattern lines so that the user may customize the size and shape of the insert to specifically fit a particular eight-point military utility cover. This device further relies on the space provided along the inside portion of the brim to maintain the insert in place during use.

All these previous devices have one thing in common; they are devices that were designed to correct a flaw that is inherent in the eight-point military utility cover. More specifically, they are devices designed to be added on to a preexisting cover after it was manufactured. The present invention is not a device, or accessory, and it cannot be added on to preexisting cover. It is integral and inclusive to the cover. It is part of the construct of original creation. It is not a device that makes a cover wrinkle free. It is a cover that is wrinkle free.

While there are many device for maintaining the integrity of caps and hats there is a continuing unmet need in the garment industry, as well as the military, for materials that are used to construct uniforms and their accessories to be less labor intensive with respect to their care. A material that can be inserted and/or secured between two pieces of cloth used to construct the garment that retains its rigidity throughout the life of the garment and can withstand the chemicals applied to remove dirt or other blemishes from the cloth as well as to withstand complete submersion in water without compromising the integrity of the material, thereby reducing or eliminating the need for ironing.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described is an eight point military utility cover or wrinkle-free eight-point military utility cover having a cup-shaped crown portion, a circular rim portion, a semi-rigid bill portion and a plurality of separate semi-rigid material sections. The crown-shaped portion has an enclosed top, an open circular bottom, a front section, a back section, three left side sections and three right side sections. The circular bottom has an inner and an outer side wherein the enclosed top has a perimeter edge. The front, back, left side and right side sections are oriented perpendicular to the circular bottom. The enclosed top is flat and slopes downward from the front section to the back section. The points are formed at locations where one section is joined to an adjoining section and to the enclosed top along the perimeter edge of the enclosed top. The circular rim portion has an outer rim portion and an inner rim portion. The inner rim portion is affixed to the outer circular bottom side of the crown-shaped portion. The circular rim portion also has a semi-rigid material core. The semi-rigid bill portion is affixed to the circular rim portion oriented and extending from and centered below the front section of the cup-shaped crown portion. The plurality of separate semi-rigid material sections each have four sides and are planar. The crown-shaped portion has a first piece and a second piece of cloth, wherein a plurality of separate semi-rigid material sections are adhered to the first piece of cloth; one semi-rigid material section on said front section, one semi-rigid material section on said back section, three separate semi-rigid material sections on said three left side sections and three separate semi-rigid material sections on said three right side sections. A second piece of cloth is adhered to the plurality of separate semi-rigid material sections on the first piece of cloth forming a three layered sheet. The three layered sheet is folded and stitched to form the crown-shaped portion.

In other embodiments, the cup-shaped crown portion, circular rim portion and bill portion of the eight point military utility cover is prepared from a canvas-type material, the separate semi-rigid material sections are adhered to a first and/or second pieces of cloth with adhesive tape, the separate semi-rigid material sections may be made of polymer, such as polypropylene or polycarbonate and may be provided in a thickness of about 0.030 to about 0.20 inches, the inner and/or outer circular rim portions may be a semi-rigid material core covered by cloth, the semi-rigid bill portion may be made of a compressed polymer foam core such as polyvinylchloride and covered by a canvas-type material, one or more vent apertures may be provided on either or both of the left side or the right side of the cup-shaped crown portion and a stretchable portion on the outer circular rim portion and/or the inner circular rim portion may be provided such that when affixed to the circular bottom, the stretchable portion is positioned on the circular bottom on the back side of the cup-shaped crown portion.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

The objects, features, and advantages of the invention will be brought out in the following part of the specification, wherein detailed description is for the purpose of fully disclosing the invention without placing limitations thereon.

BRIEF DESCRIPTION OF THE DRAWINGS

FIG. 1 shows a typical an eight point military utility cover.

FIG. 2 shows a cross sectional view of a typical eight point military utility cover.

FIG. 3 shows an enlarged view of the front of the cover with the connection of the crown portion to the circular rim portion and bill portion of a typical eight point military utility cover.

DETAILED DESCRIPTION OF THE INVENTION

Figures 4, 5:
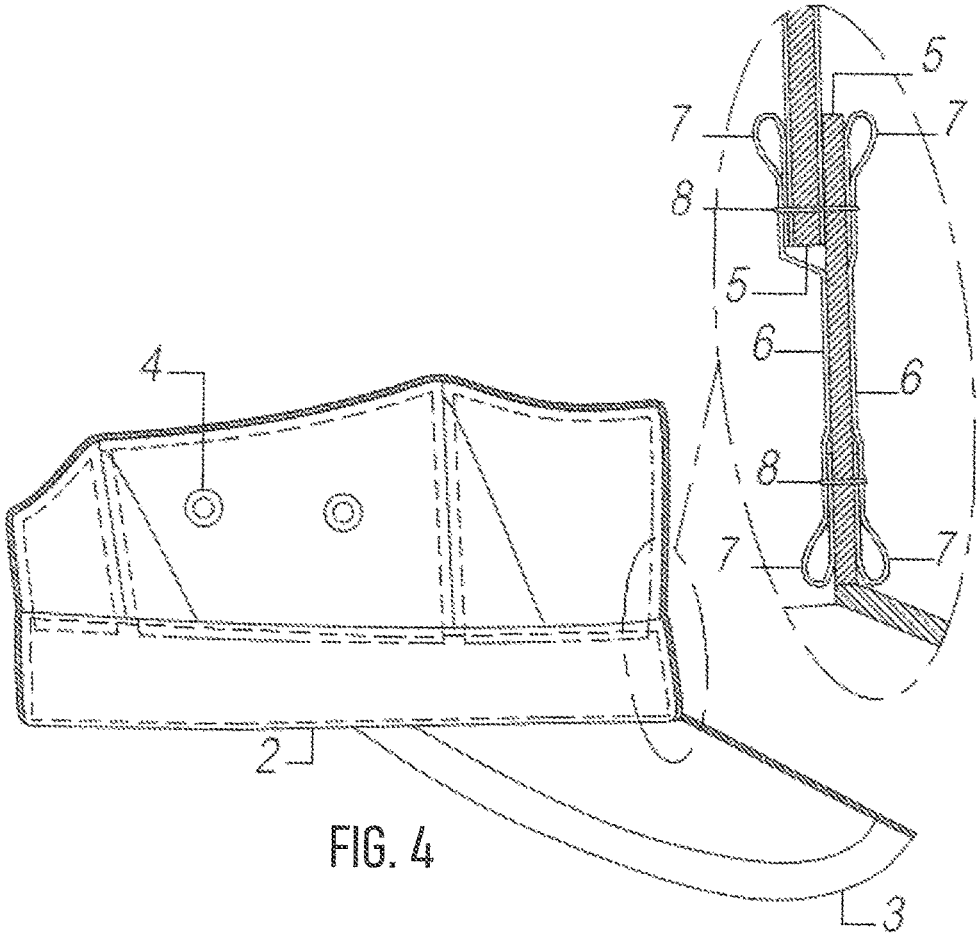
FIG. 4 shows a cross sectional view of the eight point military utility cover or wrinkle-free eight-point military utility cover of the present invention.
FIG. 5 shows an enlarged view of the front of the cover with the connection of the crown portion to the circular rim portion and bill portion of an eight point military utility cover of the present invention.

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "adhesive tape" as used herein refers to a thin polymer sheet, cloth strip or paper sheet with adhesive on one or both sides, such as for example Killer Red™. The adhesive selected is able to bind to fabric and cloth to a separate semi-rigid material prepared from, for example a flat polymer sheet. The adhesive maintains adherence of the for extended period of time (e.g. about 2 months, about six months, about a year, about two years, about five years, about ten years or longer) and under adverse conditions such as high heat, moisture, rain, submersion in water and resistant to common detergents used for cleaning such items.

The term "affixed" as used herein refers to both physical methods of attaching one element of the invention to another such as by nail, screw, rivet and the like as well as to compositions that may be used to attach one element of the invention to another such as adhesive, fusing, brazing, welding and the like.

The term "canvas-type material" as used herein refers to a material used in the military such as is Marpat™. Canvas and canvas type materials are durable plain-woven fabric historically making sails, tents, backpacks, shelters and for other items for which sturdiness is required, as well as in such fashion objects as handbags, electronic device cases, and shoes. Modern canvas is usually made of cotton or linen, along with polyvinyl chloride (PVC), although historically it was made from hemp.

The term "cup-shaped crown portion" as used herein refers to the portion of the eight-point military utility cover above the circular rim portion that covers the top of the wearer's head during use. The cup-shaped crown portion has an enclosed, relatively flat, top that slopes downward from the front to the back. It has a front section, a back section, three left side sections and three right side sections that extend downward from the relatively flat top and are parallel to the circular rim portion forming an open circular bottom that attaches to the circular rim portion. The area along the relatively flat top from which these sections extend, forms a perimeter edge. The locations along the perimeter edge where one section is joined to an adjoining section and to said enclosed top form the eight points of the eight-point military utility cover.

The term "separate semi-rigid material sections" as used herein refers to the material sections of the present invention that introduce a rigidness to the fabric to which these sections are associated and provides a stiffness greater than the cloth itself thereby preventing wrinkling of the fabric during use. The types of materials used to prepare the semi-rigid material sections include sections that may be prepared from several different gauges of flat sheet polymer as well as materials that are as flexible as the fabric used to prepare the invention but when heated form a flat semi-rigid polymer sheet. Different gauge sheet polymer may be selected based on how the hat or cover is to be prepared. The thickness of the polymer may range from 0.1 mm to 1.0 mm; in inches this range may be from about 0.010 to about 0.030. Types of polymer that may be used include, for example, polypropylene, polyvinylchloride, nylon and the like. Thicker gauge polymer sections may be cut separately and applied to the cloth in the desired pattern before the cloth is folded and stitched into the shape of the hat or cover. Alternatively, lighter gauge sheet polymer may be used that does not require multiple pieces be cut, but allows for a single donut-shaped piece to be prepared from the polymer sheet that can then be bent into shape with the cloth and folded before stitching. The extra folded portions of the lighter gauge polymer and cloth can then be cut and removed before the other elements of the hat or cover are affixed. In another method, a heat sensitive polymer felt may be used and applied to the cloth during assembly. Once a portion of the hat or cover is complete and before another element of the hat is affixed, it is heat treated, which allows the fibers to adhere to one another forming a semi-rigid structure. One type of polymer fiber that may be used in Fosshape™ sold by Wonderflex World (Brentwood, N.H.). These separate semi-rigid material section have four sides, are flat or planar, generally rectangular or quadrilateral in shape and depending on the section or portion of the eight-point military utility cover in which the separate semi-rigid material section is to be fitted it may be square, rectangular, trapezoidal, isosceles trapezoidal or irregular quadrilateral in shape. Depending on the location along the side sections of the eight-point military cover the semi-rigid material sections can be from about 2.5 cm, about 3.0 cm, about 3.5 cm, about 4.0 cm, about 4.5 cm, about 5.0 cm, about 5.5 cm, about 6.0 cm, about 6.5 cm, about 7.0 cm, about 7.5 cm, about 8.0 cm, about 8.5 cm, about 9.0 cm, about 9.5 cm, about 10.0 cm, about 11.0 cm, about 12.0 cm or about 13.0 cm in height and about 2.5 cm, about 3.0 cm, about 3.5 cm, about 4.0 cm, about 4.5 cm, about 5.0 cm, 5 about. 5 cm, about 6.0 cm, about 6.5 cm, about 7.0 cm, about 7.5 cm, about 8.0 cm, about 8.5 cm, about 9.0 cm, about 9.5 cm or about 10.0 cm in width. For the circular rim portion the semi-rigid material sections may be about 1.0 cm, about 1.5 cm, about 2.0 cm, about 2.5 cm, about 3.0 cm, about 3.5 cm, about 4.0 cm or about 5.0 cm in height and 40.0 cm, 45.0 cm, 50.0 cm, 55.0 cm, 60.0 cm, 65.0 cm, 70.0 cm, 75.0 cm or 80.0 cm in length.

The term "cloth" as used herein refers to woven material that is generally flexible with the degree of flexibility dependent on the specific materials thickness. In the present invention, the seven-point utility cover is generally for use in the military wherein garments worn by enlisted personnel must be of a grade and fabric that will withstand repeated use in the field under relatively extreme conditions when compared to conditions experienced by civilian personnel. Because of this, the cloth used to prepare military garments is of heavier weight such as a canvas or canvas-type material, and have approved patterns that help camouflage military personnel during operations. Heavier weight cloths include the military fabrics sold by Milliken Military Fabrics (Spartanburg, S.C.) and include Marpat™ fabrics.

The term "eight point military utility cover" as used herein refers to hat or cover utilized by the military for different applications on and off the battle field since 1943. It is unique in its configuration and differs significantly from dress covers used by military personnel for special "non-field" events. All dress covers utilized by the United States military including the Navy, Army, Marines, and Airforce, as well as the Coastguard, have circular or semi-oval top perimeter edges. None have the eight sided configuration of the eight-point military utility cover. The crown portion of the eight-point military utility cover has an enclosed flat top that slopes downward from the front of the hat to the back of the hat, it has a perimeter edge along the enclosed flat top, where the top meets the eight sides of extending downward from the enclosed top forming a circular bottom; the front, back, three left side and three right side sections are relatively planar and "oriented perpendicular" to the circular bottom of the crown portion, the height of the side sections along the front of the hat are greater than the height of the side sections along the back of the hat; and the locations where one side section is joined to an adjoining side section and to the enclosed top along the perimeter edge of the enclosed top form "points". Because there are eight side panels, there are eight "points" formed along the perimeter edge of the enclosed flat top. These are the inherent characteristics of an eight-point military utility cover as understood by those skilled in that art and as utilized by the military since 1943.

The term "wrinkle-free" as used herein refers to the ability of the eight-point military utility cover's construction that avoids wrinkling. It does not mean that the eight-point military utility cover could not form a wrinkle during use. It is a comparison of the amount of wrinkles, wrinkling, or ability to wrinkle of a typically commercially available eight-point military utility cover as compared to the eight-point military utility cover of the present invention, particularly in areas where the separate semi-rigid material sections are provided.

The present invention is an eight point military utility cover or wrinkle-free eight-point military utility cover having a cup-shaped crown portion, an outer circular rim portion, an inner circular rim portion and a semi-rigid bill. The crown portion has an enclosed top, an open circular bottom, a front, a back, a left side and a right side, wherein the circular bottom has an inner and an outer side. The outer circular rim portion is affixed to the outer circular bottom of the cup-shaped crown portion. The inner circular rim portion is affixed to the inner circular bottom of the cup-shaped crown portion. The semi-rigid bill portion is affixed to the circular rim oriented and extending from the front of the cup-shaped crown portion. The crown portion is prepared from a first piece and a second piece of cloth, wherein a plurality of semi-rigid material sections are adhered to the first piece of cloth; one semi-rigid material section on the front, one semi-rigid material section on the back, three semi-rigid material sections on the left side and three semi-rigid material sections on the right side, wherein the second piece of cloth is adhered to the plurality of semi-rigid material sections on the first piece of cloth forming a three layered sheet. The three layered sheet is folded into the cup-shaped crown and the folds are stitched to maintain said cup-shape of the crown.

Unlike previous devices that are designed to correct a flaw that is inherent in the eight-point military utility cover by providing a construction that could be added to a preexisting cover after it was manufactured, the present invention is not an accessory, and it cannot be added on to preexisting cover. It is integral and inclusive to the cover and is part of the construct of original creation. It is a cover that is wrinkle free. It is not a devise that makes a cover wrinkle free.

Cloth

A variety of cloths or woven fabrics may be used to prepare the hat or cover of the present invention. While heavy duty materials, such as canvas or canvas-type materials, are preferred for military use, other lesser weight materials may be used when preparing these same hats or covers for civilian use. The primary limitation for the use of lesser weight material cloths is that they be able to withstand and maintain their integrity when affixed to and stitched over the semi-rigid material sections to prepare a hat or cover of the present invention. One skilled in the art could easily test materials intended for use by preparing a prototype and introducing the prototype to anticipated environmental conditions to determine its suitability for a particular use.

A military garment must use material that complies with requirements set forth by the government for type, color and/or pattern. The eight-point utility cover when prepared for military use may be prepared from a variety of approved materials sold by a number of suppliers including Milliken Military Fabrics (Spartanburg, S.C.) and Herculite (Emigsville, Pa.). A specific material of interest for the production of seven-point utility covers for Marines is Marpat™ fabrics. Other fabrics that could be used include ABU (Airman Battle Uniform) digital tiger stripe utilized by the U.S. Air Force, AOR-1 (NWU Type I, Type II or Type III) digital pattern utilized by the U.S. Navy, Desert Camouflage Pattern three-color and six-color Woodland and Universal Camouflage Pattern digital utilized by the U.S. Army, and Tactical Assault Camouflage (TACAM) Woodland utilized by the U.S. Counterterrorism Center. Hats and covers of this type may also be made for civilian commercial purchase using any number of camouflage patterns used in other countries such as the Australian Multicam Woodland, the Canadian Disruptive Pattern (CADPAT) digital, the Finish M05 pattern digital, the Mexican marina Trans Jungle (US4CES), the British Multi-Terrain pattern and the Chinese Type 07 pattern digital.

These cloths are not wrinkle-proof but when treated can maintain their integrity for a period of time during use. Chemical treatments such as heating with an iron after applying an aerosol starch solution are often utilized. However, without a physical support these cloths eventually crease and wrinkle, and if not continuously maintained, these creases can become fixed in the cloth.

The patterns for the hat or cover can be cut from sheet cloth or fabric before the application of the semi-rigid material sections or the sections may be applied to the fabric of cloth before the pattern is cut. In one method, the pattern is first applied to the cloth or fabric. This can be accomplished by providing a drawing of the pattern directly on the reverse side of the cloth. Once the pattern is applied, the semi-rigid material section may then be adhered to their specific locations following the pattern on the cloth.

In some patterns, air holes may be punched in desired locations with the perimeter of the hole being stitched to prevent fraying or grommets may be affixed to secure the edges.

Adhesives

A variety of adhesives may be used with the present invention to adhere the semi-rigid material sections to the fabric or cloth 6 before stitching 8. Preferably, these adhesives do not soak into or saturate the fabric but adhere the surface of the fabric or cloth 6 to the semi-rigid material sections 5. It is preferable that the adhesive maintain contact between the cloth or fabric 6 and the semi-rigid material sections 5 for the life of the garment but this is not required. Adhesive may be applied to only one side of the separate semi-rigid material sections or both. In one method of preparation, the semi-rigid material sections 5 are adhered on both sides to the two cloth pieces 6 with adhesive and then sealed within the cover 10 by stitching 8 completely around the semi-rigid material sections 5. In view of this type of construction, the loss of adhesive gripping after the cover 10 has been completed, does not reduce the non-wrinkling capability of this construction since the sections are secured in place by stitching 8.

The adhesive could be applied by brushing onto the semi-rigid material sections 5, which are then adhered to the fabric or cloth 6 at desired locations or vice versa. Liquid adhesives are known in the art. One example is Singer Stitch Free Fabric Glue that can be purchased online at Target (Minneapolis, Minn.). Alternatively, the adhesive could be sprayed on the cloth or fabric 6 and the separate semi-rigid material sections 5 placed on the sprayed cloth in the desired locations before stitching 8 or vice versa. Spray adhesives are also known in the art. One example for a spray fabric adhesive is 3M Super 77 Spray Adhesive-Low VOC sold over the internet at Uline (Pleasant Prairie, Wis.). Another alternative would be the use of a double sided adhesive tape that could be applied to the separate semi-rigid material section 5 that could then be applied to the cloth or fabric 6 in the desired locations before stitching 8. A variety of double sided tapes may be used. One example is Killer Red™ that may be obtained from Bron (Denver, Colo.).

While the application of adhesive assists in maintaining a smooth appearance of the cloth over the separate semi-rigid material sections it is not required. Stitching of the separate semi-rigid sections between two sheets of cloth can be performed in such a way that they are so tightly held and enclosed between the two pieces of cloth that adhesive may be unnecessary.

Semi-Rigid Material Sections

The semi-rigid material sections 5 include the sections that are applied in the cup-shaped crown portion 1, the inner circular rim, the semi-rigid bill portion 3, and the outer circular rim portion 2. These semi-rigid material sections 5 may be prepared from sheets of a variety of relatively flexible polymeric plastics such as polypropylene, polyvinylchloride or nylon. The bill 3 may additionally be made of a polyvinylchloride polymer foam core. The thickness of the polymer sheet utilized will depend on the desired firmness of the sections 5 of the hat or cover 10 produced to resist wrinkling while at the same time allow for ease of cleaning. The thickness of the polymer may range from about 0.005 to about 0.30, from about 0.007 to about 0.25, about 0.010 to about 0.20, about 0.013 to about 0.18, about 0.005, about 0.010, about 0.015, about 0.020, about 0.025, about 0.030, about 0.050, about 0.10, about 0.15, about 0.20, about 0.25 or about 0.30. The semi-rigid material sections 5 may be cut freehand with a cutting tool such as scissors or razor blade or they may be die cut or laser cut.

These separate semi-rigid material section have four sides, are flat or planar, generally rectangular or quadrilateral in shape and depending on the section or portion of the eight-point military utility cover in which the separate semi-rigid material section is to be fitted it may be square, rectangular, trapezoidal, isosceles trapezoidal or irregular quadrilateral in shape. Depending on the location along the side sections of the eight-point military cover the semi-rigid material sections can be from about 2.5 cm, about 3.0 cm, about 3.5 cm, about 4.0 cm, about 4.5 cm, about 5.0 cm, about 5.5 cm, about 6.0 cm, about 6.5 cm, about 7.0 cm, about 7.5 cm, about 8.0 cm, about 8.5 cm, about 9.0 cm, about 9.5 cm, about 10.0 cm, about 11.0 cm, about 12.0 cm or about 13.0 cm in height and about 2.5 cm, about 3.0 cm, about 3.5 cm, about 4.0 cm, about 4.5 cm, about 5.0 cm, 5 about. 5 cm, about 6.0 cm, about 6.5 cm, about 7.0 cm, about 7.5 cm, about 8.0 cm, about 8.5 cm, about 9.0 cm, about 9.5 cm or about 10.0 cm in width. For the circular rim portion the semi-rigid material sections may be about 1.0 cm, about 1.5 cm, about 2.0 cm, about 2.5 cm, about 3.0 cm, about 3.5 cm, about 4.0 cm or about 5.0 cm in height and 40.0 cm, 45.0 cm, 50.0 cm, 55.0 cm, 60.0 cm, 65.0 cm, 70.0 cm, 75.0 cm or 80.0 cm in length.

When applying the semi-rigid sections to the cloth 6, the adhesive may be affixed as double sided tape or as a sprayed onto the semi-rigid sections 5, which are then adhered to the cloth at a desired location preferably identified by a pattern provided on the cloth 6. Alternatively, adhesive may be sprayed or applied as double sided tape on the cloth 6 wherein the semi-rigid sections 5 are then adhered. One skilled in the art may use more than one type of adhesive and may provide the adhesive both on the cloth 6 and on the semi-rigid sections 5.

During preparation of the eight-point military utility cover, the semi-rigid material sections are adhered to a first piece of cloth; one the front section, one on the back section, one semi-rigid material section on each of the three left side sections and one semi-rigid material section on each of the three right side sections. A second piece of cloth is adhered to the semi-rigid material sections on the first piece of cloth forming a three layered sheet. When this three layered sheet is folded and stitched together it forms the crown-shaped portion. A semi-rigid material section is also incorporated into the circular rim portion in a similar fashion.

This three-layered construction used in preparing the portions of the eight-point military utility cover is unique over previous devices, which are designed to be added on to a preexisting cover after it was manufactured. The present invention is not a device, or accessory, and it cannot be added on to a preexisting cover. It is integral to the cover and is part of the construction of original creation. It is not a device that makes a cover wrinkle free. It is a cover that is wrinkle free.

Preparation

The cover 10 may be prepared utilizing a variety of methods and in a variety of steps that may be required to be performed in a particular order. One example of a method that may be used to prepare the cover 10 is provided in the following steps:

Preparation of semi-rigid material sections 5 for the cup-shaped crown portion: pre-sized and numbered templates of each separate semi-rigid material section are traced onto a flat polypropylene semi-rigid polymer sheet. In this method, both sides of the polymer sheet is provided with an adhesive having a protective cover. The pre-sized separate semi-rigid material sections are cut from this flat sheet and are used to form the rigid support for the front, back, three left side and three right side sections of the cup-shaped crown portion, the squares are numbered, as are the templates, according to their position in the cup-shaped crown portion.

Preparing the interior cloth section: a numbered template for the cloth that will form the interior of the cover 10 is laid over the desired cloth 6 and cut, the adhesive protective cover is peeled off of the separate semi-rigid material sections prepared above and they are adhered in their proper location identified by the numbering provided by the template.

Preparing the exterior cloth section: peel off the adhesive protective cover from the separate semi-rigid material sections presently adhered to the interior cloth section, place the exterior cloth section 6 (pattern up) onto the interior cloth section sufficiently to cover all of the separate semi-rigid material sections from above, iron both sides to assure a good adhesive connection. This forms a three layered sheet, comprising an interior cloth on one side, an exterior cloth on the other side with the separate semi-rigid material sections in between. The cloth between the length of the height side edges of adjoining separate semi-rigid material sections are brought close together and stitched. The triangular flap of excess cloth along the stitching is cut and the circular bottom of the cup-shaped crown portion is trimmed to about ½ inch from the separate semi-rigid sections 5.

Preparing air holes 4: on specific semi-rigid section 5 that form the sides of the cover 10 a desired number of holes 4 in the desired location are punched from the cloth 6 and polymer and grommets are set into the air holes 4 covering and securing the cloth edges to the separate semi-rigid polymer sections 5.

Stitching 8: If an emblem is desired, it is affixed at the desired location prior to sewing the cup-shaped crown portion 1, the semi-rigid polymer sections 5 are brought together edge to edge and the seam is sewn until the cup-shaped crown portion 1 forms a cup-shape and the excess cloth it trimmed where it will meet the brim of the cover 10.

Affixing the outer brim 2: the location of the outer brim 2 is measured and marked on the outer edge of the cup-shaped crown portion 1, the semi-rigid polymer section 5 having a dimension of about 1³⁄₁₆" W×24" L is cut from the polymer sheet and an adhesive having a protective cover is added to both sides. The protective cover is peeled from one side of the brim, the outer brim 2, is affixed to the edge of the cup-shaped crown portion 1 and trimmed to the desired size.

Affixing the bill 3: the bill 3 in prepared from a preformed semi-rigid polyvinylchloride foam core on which the desired cloth 6 is stitched 8 leaving extra cloth material on the connecting edge of the bill 3, adhesive is applied to this extra cloth material on the upper side of the bill 3, this upper portion of the bill 3 is then affixed to the interior side of the front of the cup-shaped crown portion 1.

Affixing the outer brim cover 2 and inner liner: two strips of cloth having the dimension of about 25" L by 2⅜" W are cut, the center of the strip is marked, adhesive is applied and the edges of the cloth 6 on each side are folded in toward the center line and secured 7, the first strip, or outer brim cover 2, is sewn end to end 8 at the desired brim diameter, the protective adhesive cover is removed from the outer brim above and the first strip adhered to the outer brim, the second strip, or inner liner, is sewn end to end 8 at the desired brim diameter and adhesive affixed to its outer side, the protective adhesive cover is removed from the double sided adhesive tape and the second strip is applied to the interior brim of the hat or cover 10.

Stitching: a seam 8 is sewn at the top and bottom edges of the outer brim cover 2 and inner liner.

As stated above, previous devices have been designed to correct a flaw that is inherent in the eight-point military utility cover. They are devices designed to be added on to a preexisting cover after it was manufactured. The present invention is not a device, or accessory, and it cannot be added on to preexisting cover. It is integral to the cover and is an inherent part of the construction of the eight-point military utility cover of this invention. It is not a device that makes a eight-point military utility cover wrinkle free. It is a cover that is wrinkle free.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

I claim:

1. An eight point military utility cover comprising:

a cup-shaped crown portion having an enclosed top, an open circular bottom, a front section, a back section, three left side sections and three right side sections, said circular bottom having an inner and an outer side wherein said enclosed top has a perimeter edge, wherein said front, back, left side and right side sections are oriented perpendicular to said enclosed top and said circular bottom, wherein said enclosed top is flat and slopes downward from said front section to said back section, wherein points are formed at locations where one section is joined to an adjoining section and to said enclosed top along said perimeter edge of said enclosed top;

wherein said crown-shaped portion comprises a first piece and a second piece of cloth;

eight separate semi-rigid material sections, wherein each of said eight separate semi-rigid material sections have four sides and are planar, wherein each of said eight separate semi-rigid material sections are adhered to said first piece of cloth; one of said eight semi-rigid material sections disposed on said front section, one of said eight semi-rigid material sections disposed on said back section, three of said eight separate semi-rigid material sections disposed on said three left side sections, and three of said eight separate semi-rigid material sections disposed on said three right side sections, wherein said second piece of cloth is adhered to said eight separate semi-rigid material-sections forming a three layered sheet;

a circular rim portion having an outer rim portion and an inner rim portion, wherein said circular rim portion comprises a semi-rigid material core;

wherein said first piece of cloth and said second piece of cloth are folded, wherein said inner rim portion is stitched to the three layered sheet; and a semi-rigid bill portion affixed to said circular rim portion oriented and extending from and centered below said front section of said cup-shaped crown portion.

2. The eight point military utility cover according to claim 1, wherein said crown-shaped portion, said circular rim portion and said semi-rigid bill portion comprise a canvas-type material.

3. The eight point military utility cover according to claim 1, wherein said eight separate semi-rigid material sections are adhered to said first and/or said second piece of cloth by an adhesive tape.

4. The eight point military utility cover according to claim 3, wherein said adhesive tape is double-sided adhesive tape.

5. The eight point military utility cover according to claim 1, wherein said eight separate semi-rigid material sections are made of a polymer.

6. The eight point military utility cover according to claim 5, wherein said polymer is polypropylene or polycarbonate.

7. The eight point military utility cover according to claim 6, wherein said polypropylene and said polypropylene polymer is 0.030 to 0.20 inches in thickness.

8. The eight point military utility cover according to claim 1, wherein said semi-rigid material core is covered by cloth.

9. The eight point military utility cover according to claim 8, wherein said cloth is a canvas-type material.

10. The eight point military utility cover according to claim 1, wherein said semi-rigid bill portion is a compressed polymer foam core covered by cloth.

11. The eight point military utility cover according to claim 10, wherein said compressed polymer foam core is made of polyvinylchloride.

12. The eight point military utility cover according to claim 10, wherein said cloth of said semi-rigid bill portion is made of a canvas-type material.

13. The eight point military utility cover according to claim 1, further comprising vent apertures wherein said vent apertures are on one or more of the three left side sections and/or on one or more of the three right side sections.

14. The eight point military utility cover according to claim 1, further comprising a stretchable portion on said circular rim portion positioned on said circular bottom on the back section of said crown-shaped portion.

15. The eight point military utility cover according to claim 1, wherein said outer rim portion comprises a semi-rigid material core covered by cloth.

* * * * *